US007385149B2

(12) United States Patent
Liu

(10) Patent No.: US 7,385,149 B2
(45) Date of Patent: Jun. 10, 2008

(54) PUSHBUTTON MECHANISM FOR KEYBOARDS

(75) Inventor: Tien-Min Liu, Taipei Hsien (TW)

(73) Assignee: Zippy Technology Corp., Hsin-Tien, Taipei (TW)

( * ) Notice: Subject to any disclaimer, the term of this patent is extended or adjusted under 35 U.S.C. 154(b) by 183 days.

(21) Appl. No.: 11/288,259

(22) Filed: Nov. 29, 2005

(65) Prior Publication Data

US 2007/0119696 A1 May 31, 2007

(51) Int. Cl.
*H01H 9/26* (2006.01)

(52) U.S. Cl. ..... 200/5 A; 200/341

(58) Field of Classification Search ..... 200/341–344, 200/512–517, 5 A
See application file for complete search history.

(56) References Cited

U.S. PATENT DOCUMENTS

| | | | | |
|---|---|---|---|---|
| 5,278,374 | A | 1/1994 | Takagi et al. | |
| 5,555,971 | A | 9/1996 | Takada | |
| 5,630,501 | A | 5/1997 | Tsay | |
| 5,964,341 | A | 10/1999 | Tsai | |
| 6,080,948 | A * | 6/2000 | Hong | 200/344 |
| 6,366,275 | B1 * | 4/2002 | Lai | 345/168 |
| 6,392,176 | B1 * | 5/2002 | Tsai | 200/344 |
| 6,428,223 | B2 | 8/2002 | Chen | |
| 6,504,120 | B2 * | 1/2003 | Hsu | 200/344 |
| 6,733,196 | B2 * | 5/2004 | Lee et al. | 400/480 |

FOREIGN PATENT DOCUMENTS

| | | |
|---|---|---|
| TW | 511772 Y | 11/2002 |
| TW | 539177 Y | 6/2003 |

* cited by examiner

*Primary Examiner*—Elvin Enad
*Assistant Examiner*—Lisa Klaus
(74) *Attorney, Agent, or Firm*—Muncy, Geissler, Olds & Lowe, PLLC

(57) ABSTRACT

A pushbutton mechanism for keyboards includes a bridge in a pushbutton that has an inner frame and an outer frame to make the pushbutton movable up and down. The inner frame and outer frame are intersected and coupled together, and have respectively inner side brackets and outer side brackets that have a stub shaft and a pivot portion to form a relative turning relationship. The inner and outer side brackets have respectively harness bosses and harness recesses corresponding to each other to allow the pushbutton to form a lifting position and a lower position in normal conditions. The bridge thus formed can generate a steadier relative turning and confine the stroke distance for the pushbutton.

9 Claims, 5 Drawing Sheets

PUSHBUTTON MECHANISM FOR KEYBOARDS

BACKGROUND OF THE INVENTION

1. Field of the Invention

The present invention relates to a pushbutton mechanism for keyboards and particularly to a pushbutton mechanism that has a bridge interposed between a key cap and a base plate to provide a steady relative turning and confine the pushbutton stroke.

2. Brief Description of the Related Art

The conventional pushbutton mechanism for thin keyboards mainly includes a bridge (or called scissors-type moving mechanism), a circuit board, an actuation means and a base plate (some also have the bridge mounting onto a bridge board, and have the circuit board interposed between the bridge board and the base plate). The techniques of the bridge mechanism can be divided into two types, each has its benefits and drawbacks as discussed below:

1. U.S. Pat. Nos. 5,278,374, 5,555,971, 5,964,341 and 6,428,223 propose a bridge that has an inner frame and an outer frame with corresponding stub shafts and pivot portions on the side brackets. The inner frame and outer frame are coupled on an axle which can reduce rotational friction to make turning smoother. But the inner and outer frames are difficult to fabricate and couple together. To control turning of the bridge to achieve a desired pushbutton stroke, extending lugs have to be provided for harness. This technique was disclosed in R.O.C. patent publication No. 511772.

2. U.S. Pat. No. 5,630,501 discloses a technique which has an inner frame and outer frame with mating bosses and recesses coupled in a straddle manner. The inner and outer frames can be fabricated and coupled together, and the bosses and recesses are corresponding to each other and can control the pushbutton stroke. An improvement is disclosed in R.O.C. patent publication No. 539177. However, the straddle coupling does not provide a desired positioning harness. A greater turning friction occurs and the frames could be separated.

3. The aforesaid conventional techniques have a common problem, namely when the inner and outer frames of the bridge are coupled together, they have to maintain a constant allowance in normal conditions during turning relative to each other to avoid contact friction between them so that wearing or fracturing can be prevented. But the present techniques of the bridge do not provide a harness mechanism for the inner and outer frames. The inner and outer frames could have transverse movements and result in damages.

SUMMARY OF THE INVENTION

Therefore the primary object of the present invention is to solve the aforesaid disadvantages. The present invention provides a bridge structure that has the advantages of the conventional bridge and also includes an axle turning relationship and a positioning harness relationship. According to the bridge of the invention, the inner and outer frames have stub shafts and pivot portions on the side brackets that correspond to each other and form a relative turning relationship. The side brackets also have harness recesses and harness bosses corresponding to each other at a lifting position and a lowering position of the pushbutton in normal conditions. Thereby the bridge can be turned steadily and confine the pushbutton stroke.

Another object of the invention is to provide a bridge with the harness recess and harness boss coupled in a direction same as the coupling juncture of the stub shaft. The harness boss is extended from the side bracket of the inner frame at a length greater than the depth of the harness recess on the side bracket of the outer frame. Hence a gap is formed between the inner frame and the outer frame to prevent contact friction between them to avoid wearing or fracturing.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

DETAILED DESCRIPTION OF THE PREFERRED EMBODIMENTS

Figure 1:
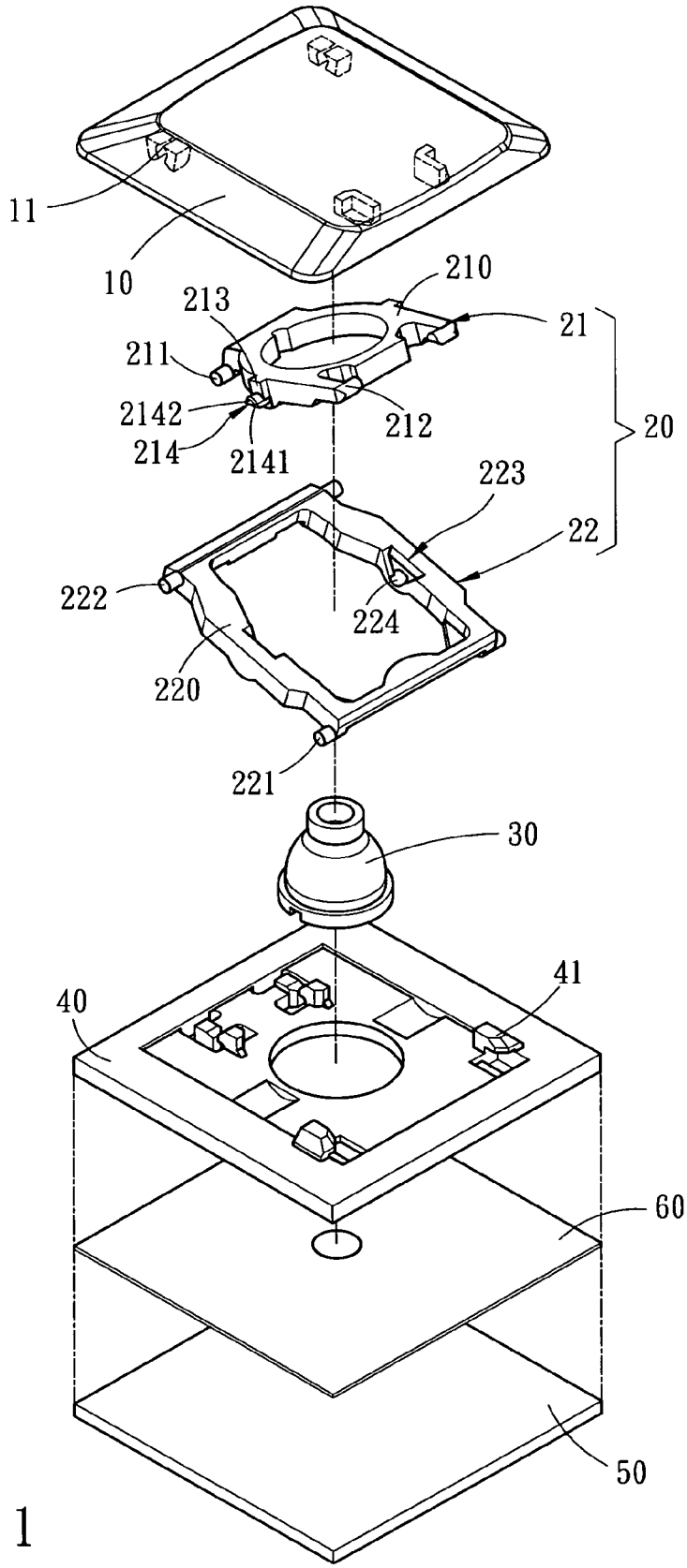
FIG. 1 is an exploded view of the pushbutton mechanism of the present invention.
Figure 2:
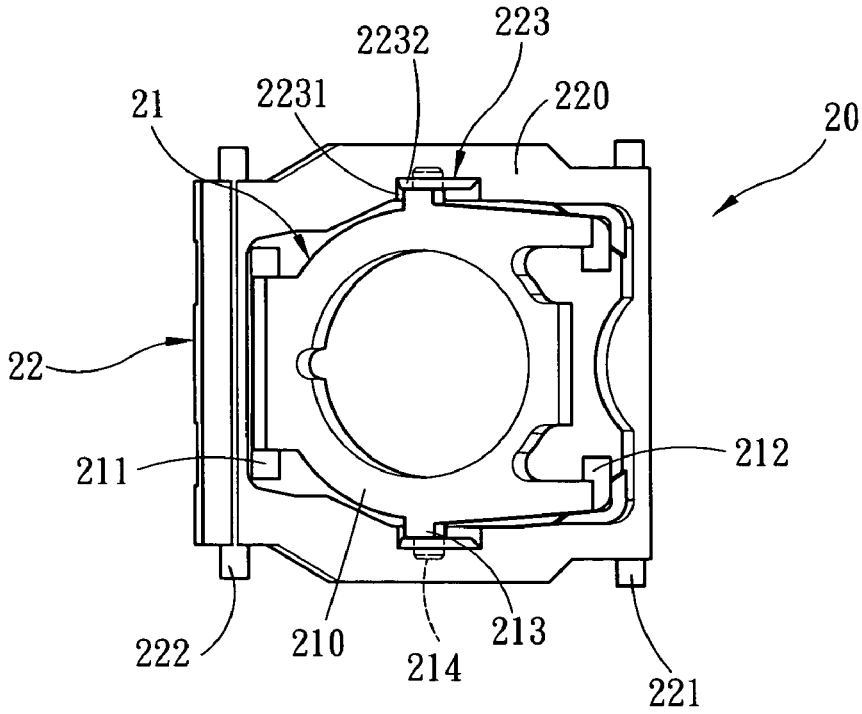
FIG. 2 is an exploded view of the bridge of the present invention.
Figure 3:
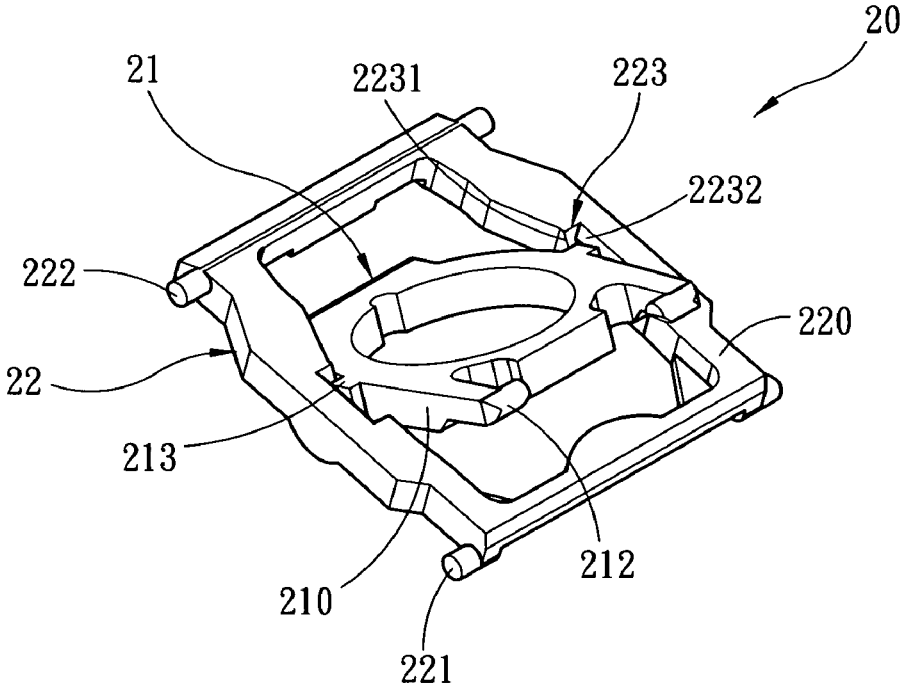
FIG. 3 is a schematic view of the bridge of the present invention in an assembled condition.

Please referring to FIGS. 1, 2 and 3, the pushbutton mechanism for keyboards according to the invention includes a bridge 20 that has an inner frame 21 and an outer frame 22 intersected and coupled together. The bridge 20 has one end coupling with a key cap 10 and another end coupling with a base plate 50. The key cap 10 and the base plate 50 are interposed by a signal triggering means. The inner end surface of the key cap 10, the inner and outer frames 21 and 22, and the base plate 50 have respectively coupling elements 11, 211, 212, 221, 222, and 41 that are coupled with one another to allow the bridge 20 to move upwards and downwards. According the existing techniques, a bridge board 40 may also be provided above the base plate 50. The coupling element 41 of the bridge 20 is located on the bridge board 40. The signal triggering means includes an elastic member 30 and a circuit board 60. If only the base plate 50 is adopted, the circuit board 60 is located between the base plate 50 and the key cap 10. If the bridge board 40 is adopted, the circuit board 60 is located between the bridge board 40 and the base plate 50. The elastic member 30 may include one or multiple units connecting to a Mylar sheet. All the previous discussion is known in the art. The invention adopts the design of the bridge board 40 as an embodiment for discussion hereinafter.

According to the invention, the outer frame 22 of the bridge 20 have outer side brackets 220 on two sides each has a harness recess 223 and a pivot portion 224 to couple with the inner frame 21. The inner frame 21 has inner side brackets 210 on two sides each has a harness boss 213 corresponding to the harness recess 223 and a stub shaft 214 corresponding to the pivot portion 224. Hence the stub shaft 214 can be coupled with the pivot portion 224 to form a relative turning relationship. The harness boss 213 can be moved in the harness recess 223 to define a lifting position and a lowering position for the pushbutton in normal conditions.

Figure 4:
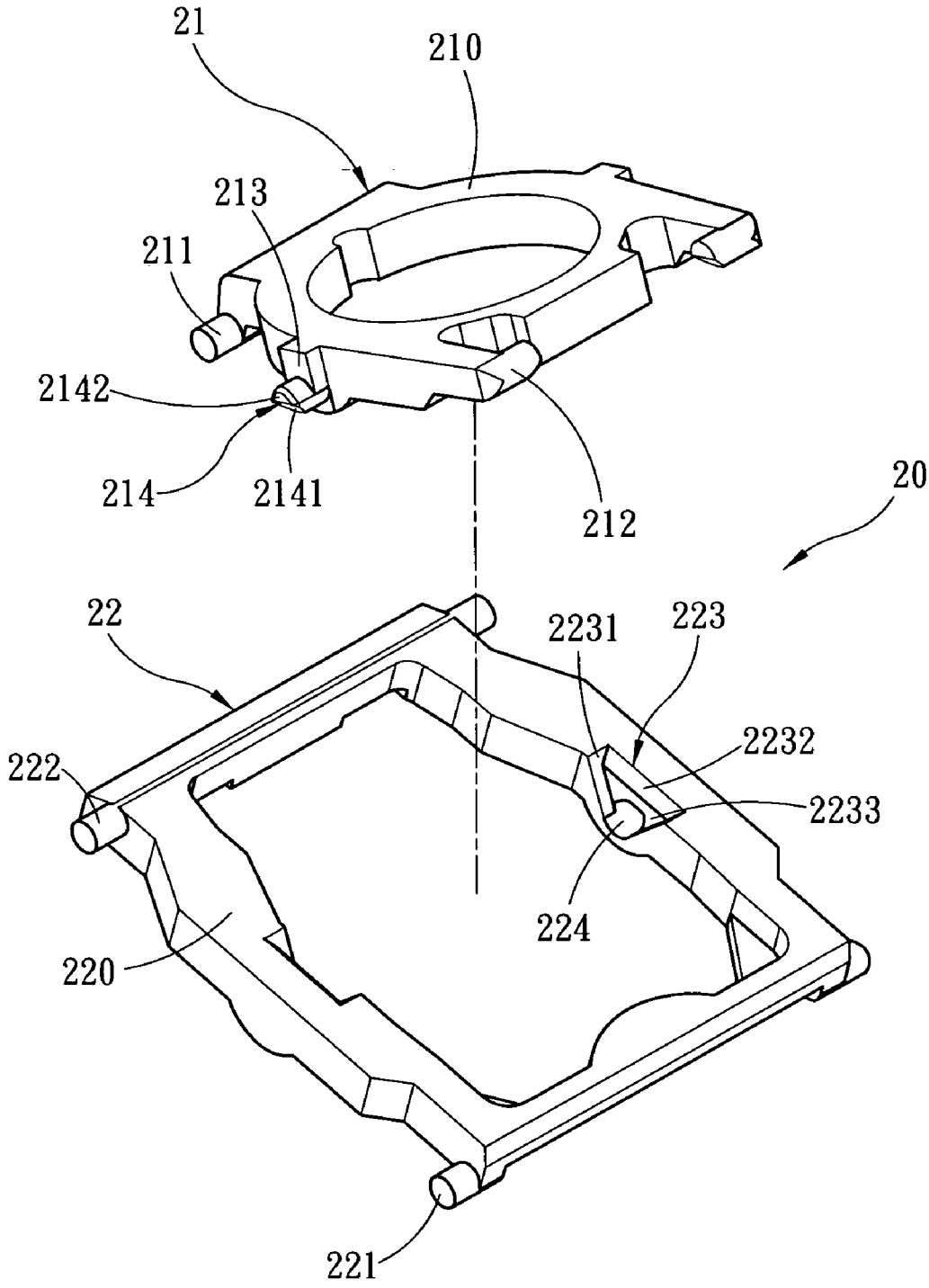
FIG. 4 is a top view of the bridge of the present invention.

While the inner frame 21 and the outer frame 22 are coupled together, the harness recess 223 and the pivot portion 224 communicate with each other, and the harness recess 223 has at least one side forming a first chamfered and tapered surface 2231 inclined from a upper end to the pivot portion 224, or the harness recess 223 has at least another side forming a second chamfered and tapered surface 2232 inclined from a upper end to the pivot portion 224. The first chamfered surface 2231 has a bottom edge reaching the pivot portion 224 to form a planar orthogonal surface 2233. Thereby the stub shaft 214 can slide on the first chamfered surface 2231 in a flexible manner to be wedged in the pivot portion 224. The harness recess 223 may also have the chamfered surfaces 2231 and 2232 formed on three sides (with the planar orthogonal surface 2233 formed on a vertical side opposing the stub shaft 214 to prevent the stub shaft 214 from escaping) to form a V-shaped channeling trough. The stub shaft 214 has a tangent surface 2141 and a rotary surface 2142 corresponding to the second chamfered surface 2232 so that the inner frame 21 can be corrected axially and channeled vertically to facilitate automatic assembly. For wedging the stub shaft 214 in the pivot portion 224, the harness boss 213 is wedged in the harness recess 223. The harness boss 213, aside from providing the push stroke for the pushbutton, also provides a vertical shearing force for automatic assembly of the inner frame 21 and the outer frame 22. The harness boss 213 is confined horizontally in an offset manner in the harness recess 223 to allow the inner frame 21 to be coupled as desired with the outer frame 22. In addition, referring to FIG. 4, the coupling direction of the harness boss 213 and the harness recess 223 is same as that of the coupling axle position of the stub shaft 214 and the pivot portion 224. The harness boss 213 is extended from the inner side bracket 210 at a length greater than the depth of the harness recess 223 on the outer side bracket 220. Hence a gap is formed between the inner frame 21 and the outer frame 22 due to coupling and bucking of the harness boss 213 and the harness recess 223. Thereby contact friction between the inner frame 21 and the outer frame 22 can be eliminated to prevent wearing or fracturing.

Figure 5B:
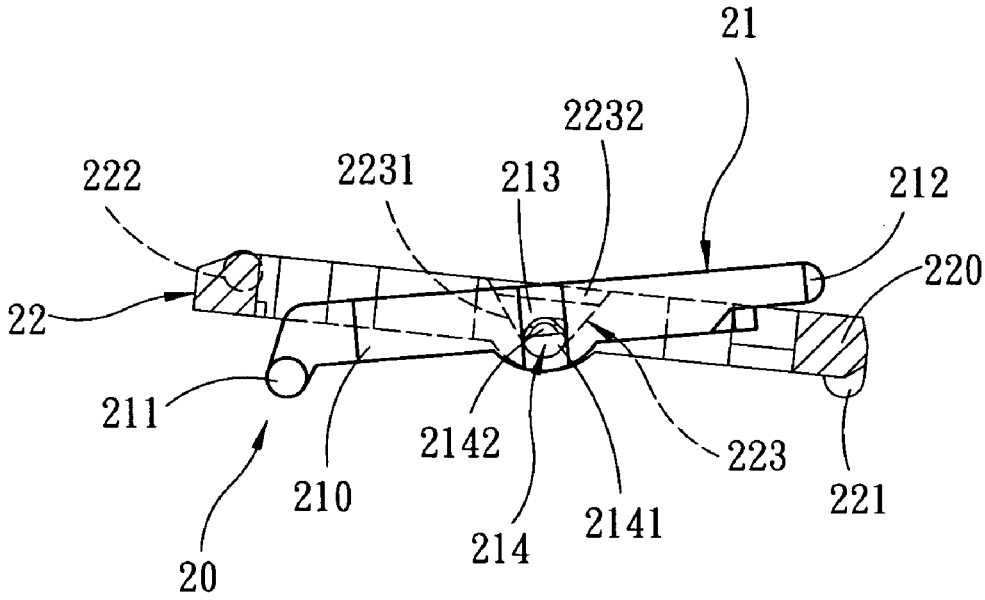
FIGS. 5A and 5B are schematic views of the bridge of the present invention in turning conditions.
Figure 5A:
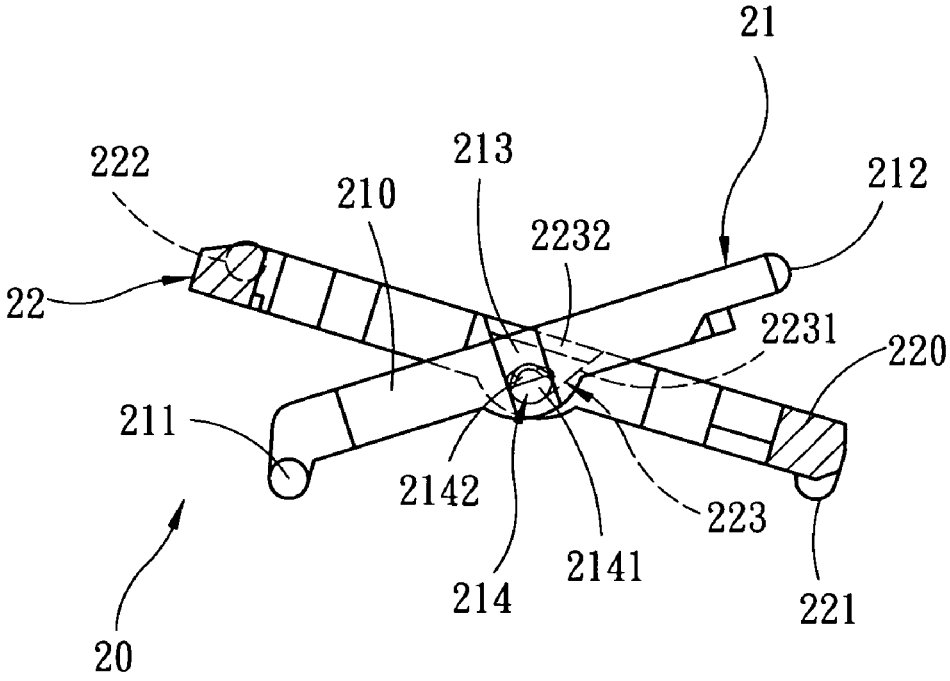
Figure 6B:
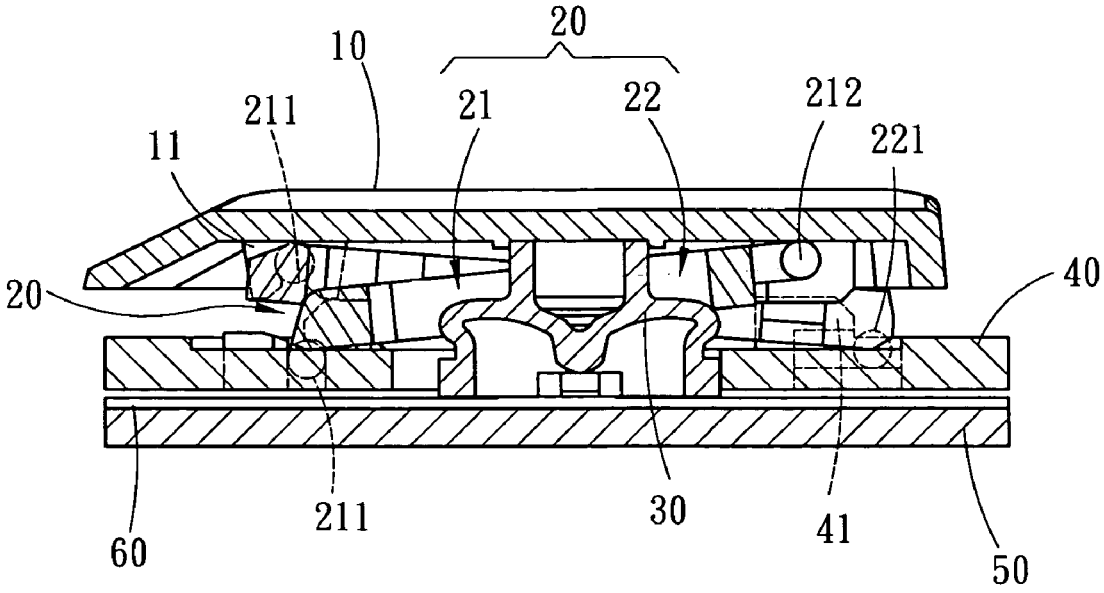
FIGS. 6A and 6B are schematic views of the keyboard of the present invention in operating conditions.
Figure 6A:
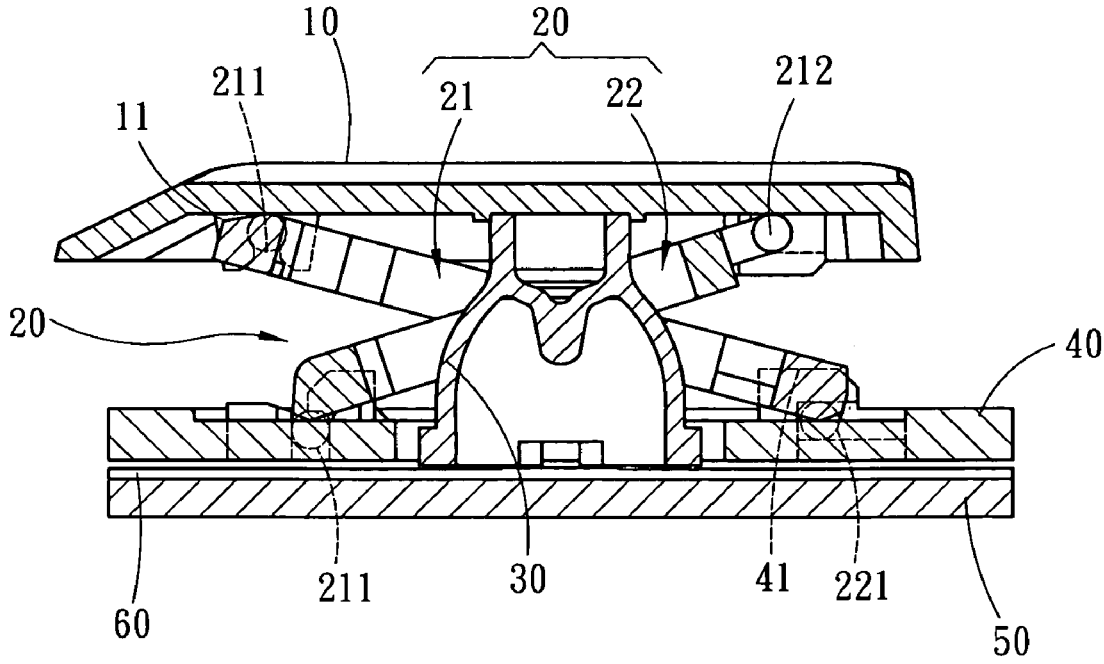

Refer to FIGS. 5A and 6A, after the bridge 20 is assembled, install the base plate 50, circuit board 60, elastic member 30 and bridge board 40 to form the pushbutton. The elastic force of the elastic member 30 pushes the key cap 10 to form the bridge 20 in a cross shape. The highest normal lifting position of the key cap 10 may be determined by the deformation degree of the elastic member 30. It also can be determined by the position of the harness boss 213 moving on one side of the harness recess 223. Hence by adjusting the relative position of the harness boss 213 or harness recess 223, the stroke distance and elevation of the pushbutton can be controlled. Referring to FIGS. 5B and 6B, when the key cap 10 is depressed to compress the elastic member 30, the lowest position of the key cap 10 is determined by the deformation degree of the elastic member 30. It also can be determined by the position of the harness boss 213 moving on another side of the harness recess 223. Hence during downward or upward movement of the bridge 20, through the stub shaft 214 of the inner frame 21 and the pivot portion 224 of the outer frame 22, a smooth turning and positioning harness can be achieved. Moreover, the relative length of the harness boss 214 and the harness recess 223 enables the inner frame 21 and the outer frame 22 to maintain a desired gap in the normal conditions. Therefore contact friction can be avoided between the inner frame 21 and the outer frame 22 during turning, and a desired click can be generated during operation of the pushbutton.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A pushbutton mechanism for keyboards, comprising:

a bridge for a pushbutton of a keyboard, the bridge including an inner frame and an outer frame that are intersected and coupled together, and having one end coupling with a key cap and another end coupling with a base plate, the key cap and the base plate being interposed by a signal triggering means, wherein the outer frame has two outer side brackets each having a harness recess and a pivot portion, and the inner frame has two inner side brackets each having a harness boss corresponding to the harness recess and a stub shaft corresponding to the pivot portion, the inner frame and the outer frame being turnable relatively to each other through coupling of the stub shaft and the pivot portion, the harness boss being movable in the harness recess to define a lifting position and a lowering position for the pushbutton in normal conditions, wherein the harness recess and the pivot portion communicate with each other, and wherein the harness recess has at least one first chamfered and tapered surface on one side inclined from a upper end thereof to the pivot portion.

2. The pushbutton mechanism of claim 1, wherein the harness recess has at least one second chamfered and tapered surface on another side inclined from a upper end thereof to the pivot portion, the second chamfered surface having a bottom edge reaching the pivot portion to form a planar surface.

3. The pushbutton mechanism of claim 2, wherein the stub shaft has a tangent surface and a rotary surface corresponding to the second chamfered surface.

4. The pushbutton mechanism of claim 1, wherein the harness boss is extended from the inner side bracket of the inner frame at a length greater than the depth of the harness recess on the outer side bracket of the outer frame.

5. A pushbutton mechanism for keyboards, comprising:

a bridge for a pushbutton of a keyboard, the bridge including an inner frame and an outer frame that are intersected and coupled together, and having one end coupling with a key cap and another end coupling with a base plate, the key cap and the base plate being interposed by a signal triggering means, wherein the outer frame has two outer side brackets each having a harness recess and a pivot portion, and the inner frame has two inner side brackets each having a harness boss corresponding to the harness recess and a stub shaft corresponding to the pivot portion, the inner frame and the outer frame being turnable relatively to each other through coupling of the stub shaft and the pivot portion, the harness boss being movable in the harness recess to define a lifting position and a lowering position for the pushbutton in normal conditions, and wherein the harness recess has at least one second chamfered and tapered surface on another side inclined from a upper end thereof to the pivot portion, the second chamfered surface having a bottom edge reaching the pivot portion to form a planar surface.

6. The pushbutton mechanism of claim 5, wherein the harness recess and the pivot portion communicate with each other.

7. The pushbutton mechanism of claim 6, wherein the harness recess has at least one first chamfered and tapered surface on one side inclined from a upper end thereof to the pivot portion.

8. The pushbutton mechanism of claim 5, wherein the stub shaft has a tangent surface and a rotary surface corresponding to the second chamfered surface.

9. The pushbutton mechanism of claim 5, wherein the harness boss is extended from the inner side bracket of the inner frame at a length greater than the depth of the harness recess on the outer side bracket of the outer frame.

* * * * *